US010578375B2

(12) United States Patent
Wang et al.

(10) Patent No.: US 10,578,375 B2
(45) Date of Patent: Mar. 3, 2020

(54) FIN AND HEAT EXCHANGER HAVING SAME

(71) Applicant: SANHUA (HANGZHOU) MICRO CHANNEL HEAT EXCHANGER CO., LTD., Hangzhou (CN)

(72) Inventors: Leilei Wang, Hangzhou (CN); Yan He, Hangzhou (CN); Xin Liang, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 0 days.

(21) Appl. No.: 15/761,689

(22) PCT Filed: Sep. 21, 2016

(86) PCT No.: PCT/CN2016/099628
§ 371 (c)(1),
(2) Date: May 1, 2018

(87) PCT Pub. No.: WO2017/050237
PCT Pub. Date: Mar. 30, 2017

(65) Prior Publication Data

US 2018/0356166 A1 Dec. 13, 2018

(30) Foreign Application Priority Data

Sep. 21, 2015 (CN) ..... 2015 1 0602848

(51) Int. Cl.
*F28F 1/32* (2006.01)
*F28F 1/30* (2006.01)

(52) U.S. Cl.
CPC ..... *F28F 1/325* (2013.01); *F28F 1/30* (2013.01); *F28F 1/32* (2013.01); *F28F 2215/08* (2013.01); *F28F 2215/12* (2013.01)

(58) Field of Classification Search
CPC ..... F28F 1/32; F28F 1/325; F28F 2215/12
(Continued)

(56) References Cited

U.S. PATENT DOCUMENTS 2,217,469 A * 10/1940 Clarke ..... F28F 1/30 165/181
4,923,002 A * 5/1990 Haussmann ..... F28F 1/32 165/151

(Continued)

FOREIGN PATENT DOCUMENTS

CN 101738126 A 6/2010
CN 202928427 U 5/2013

(Continued)

OTHER PUBLICATIONS

International Search Report and Written Opinion of the International Searching Authority for PCT International Application No. PCT/CN2016/099628 dated Dec. 30, 2016.

(Continued)

*Primary Examiner* — Joel M Attey
(74) *Attorney, Agent, or Firm* — Howard & Howard Attorneys PLLC

(57) ABSTRACT

A fin and a heat exchanger having the fin, wherein the fin includes a sheet body. The sheet body includes a plurality of cooling sheet units arranged along a longitudinal direction of the sheet body. Each cooling sheet unit includes a windward zone, a main heat exchange zone and a leeward zone arranged along a transverse direction of the sheet body. The windward zones of adjacent cooling sheet units are connected to each other. A flat tube groove extends between the leeward zone and the main heat exchange zone of one of the adjacent cooling sheet units and the leeward zone and the main heat exchange zone of the other of the adjacent cooling (Continued)

sheet units. Each cooling sheet unit is provided with a plurality of protrusions spaced apart from each other.

15 Claims, 9 Drawing Sheets

(58) Field of Classification Search
USPC ..... 165/151, 152
See application file for complete search history.

(56) References Cited

U.S. PATENT DOCUMENTS

| | | | | | |
|---|---|---|---|---|---|
| 5,775,413 | A * | 7/1998 | Kawanabe | F28F 1/32 | 165/151 |
| 6,889,757 | B2 * | 5/2005 | Iwasaki et al. | F28D 1/0435 | 165/135 |
| 2002/0134537 | A1 * | 9/2002 | Memory | B21D 53/085 | 165/151 |
| 2009/0199585 | A1 * | 8/2009 | Ogawa | F28D 1/0477 | 62/324.2 |
| 2013/0299142 | A1 * | 11/2013 | Yoshioka et al. | F28D 1/05383 | 165/151 |
| 2013/0299152 | A1 * | 11/2013 | Ohtani et al. | F28D 1/05383 | 165/181 |

FOREIGN PATENT DOCUMENTS

| | | | | | |
|---|---|---|---|---|---|
| CN | 203550714 | U | | 4/2014 | |
| CN | 203980989 | U | | 12/2014 | |
| CN | 104285119 | A | | 1/2015 | |
| CN | 104482791 | A | | 4/2015 | |
| CN | 204359185 | U | | 5/2015 | |
| CN | 104764353 | A | | 7/2015 | |
| CN | 204787982 | U | | 11/2015 | |
| FR | 2832789 | A1 | * | 5/2003 | F28D 1/0435 |
| JP | 63294494 | A | * | 12/1988 | F28F 1/325 |
| JP | 3264525 | B2 | * | 3/2002 | F28F 19/006 |
| JP | 4679542 | | * | 10/2008 | |
| JP | 2008241057 | A | * | 10/2008 | |
| JP | 2012154493 | A | | 8/2012 | |
| JP | 2013137151 | A | | 7/2013 | |
| JP | 2015132468 | A | | 7/2015 | |

OTHER PUBLICATIONS

First Office Action for Chinese Patent Application No. 201510602848.6 dated Mar. 4, 2019.

* cited by examiner

FIN AND HEAT EXCHANGER HAVING SAME

CROSS-REFERENCE TO RELATED APPLICATIONS

The present application is a national phase entry under 35 USC § 371 of PCT International Patent Application No. PCT/CN2016/099628 filed on Sep. 21, 2016, which claims priority to and all the benefits of Chinese Patent Application No. 201510602848.6 filed on Sep. 21, 2015, the entire disclosures of which are incorporated herein by reference.

BACKGROUND OF THE INVENTION

1. Field of the Invention

The present disclosure relates to a technical field of heat exchangers, and more particularly to a fin and a heat exchanger having the fin.

2. Description of the Related Art

The micro-channel heat exchanger in the related art consists of a header pipe, a flat tube and a fin. The fin is disposed between adjacent flat tubes, a surface of the fin is provided with a shutter occupying the vast majority of the fin, a windward end of the fin has a higher heat exchange intensity, which causes more condensing water or frosting amount at the windward end of the fin. The frosting at the surface of the fin reduces an effective heat exchange area of the heat exchanger, and systems such as an air conditioner applying the heat exchanger enter a defrost process frequently, influencing stability of the temperature. The condensing water at the surface of the fin flows downward and is discharged relying on an action of gravity, however, as a flowing path of the condensing water is longer, it is difficult to discharge the condensing water, which increases the heat exchange resistance of the heat exchanger and influences the heat exchange capacity of the heat exchanger.

SUMMARY OF THE INVENTION

The present disclosure aims to solve at least one of the technical problems existing in the related art. Thus, the present disclosure needs to provide a fin, which exhibits a high discharging speed of condensing water and a low frosting speed, so that the heat exchange performance of the heat exchanger can be improved and the stability of the temperature of the heat exchange system can be increased.

The present disclosure further needs to provide a heat exchanger.

The fin according to embodiments of a first aspect of the present disclosure includes a sheet body, the sheet body includes a plurality of cooling sheet units arranged along a longitudinal direction of the sheet body, each cooling sheet unit includes a windward zone, a leeward zone and a main heat exchange zone arranged along a transverse direction of the sheet body, the main heat exchange zone is located between the windward zone and the leeward zone, the windward zones of adjacent cooling sheet units are connected to each other, a flat tube groove is formed between the adjacent cooling sheet units, the flat tube groove extends between the leeward zone and the main heat exchange zone of one of the adjacent cooling sheet units and the leeward zone and the main heat exchange zone of the other of the adjacent cooling sheet units, each cooling sheet unit is provided with a plurality of protrusions protruding from a surface of the cooling sheet unit and spaced apart from each other.

The fin according to embodiments of the present disclosure can perform sufficient dehumidification to the air, slow down the frosting speed of the windward zone of the fin, thus improving the heat exchange efficiency of the heat exchanger and the stability of the temperature of the heat exchange system. Furthermore, the plurality of protrusions also accelerates the discharging speed of the condensing water, thus improving the overall performance of the heat exchange system.

According to some embodiments of the present disclosure, the protrusion is provided with a flow-guiding curved surface or a flow-guiding inclined surface.

According to some embodiments of the present disclosure, the protrusion is formed to be in a hemispherical shape, a cylindrical shape or a conic shape, or to be a column or a cone having a polygonal cross section.

According to some embodiments of the present disclosure, the plurality of protrusions is separated into a plurality of groups, each group of the protrusions is arranged to be in a straight line, a triangle or a polygon.

According to an embodiment of the present disclosure, the protrusions are only provided in the main heat exchange zone and the leeward zone.

According to an embodiment of the present disclosure, the sheet body has a corrugated part located in the windward zone, and a wave crest and a wave trough of the corrugated part extend along the longitudinal direction of the sheet body separately.

Further, the corrugated part in the windward zone is separated from the main heat exchange zone by a planar zone Optionally, a ratio of an area of the planar zone to an area of the windward zone is 20%.

According to an embodiment of the present disclosure, the main heat exchange zone is further provided with a shutter, and the shutter is adjacent to the leeward zone.

Optionally, the protrusions are only provided in the main heat exchange zone and the leeward zone, and the shutter is located between the protrusions in the main heat exchange zone and the protrusions in the leeward zone.

Optionally, the shutter includes a first shutter and a second shutter spaced apart along the transverse direction of the sheet body, the second shutter is more adjacent to the leeward zone relative to the first shutter, the first shutter is provided with a plurality of first air-guiding sheets extending obliquely from the main heat exchange zone to the leeward zone, and the second shutter is provided with a plurality of second air-guiding sheets extending obliquely from the main heat exchange zone to the windward zone.

Preferably, a spacing of adjacent first air-guiding sheets is larger than a spacing of adjacent second air-guiding sheets.

According to some embodiments of the present disclosure, a projection of the protrusion on a plane where the sheet body exists is a circle, and in the main heat exchange zone, a smallest spacing of an edge of the flat tube groove from an outer periphery of the circle is not smaller than a radius of the circle.

Optionally, a diameter of the circle is 20%-30% of a height of the cooling sheet unit in the longitudinal direction.

According to some embodiments of the present disclosure, an area of a projection of the protrusion in the leeward zone on the plane where the sheet body exists is not larger than an area of a projection of the protrusion in the main heat exchange zone on the plane where the sheet body exists.

According to an embodiment of the present disclosure, the edge of the flat tube groove is provided with a flanging.

Further, a bending direction of the flanging is consistent with a protruding direction of the protrusions.

According to some embodiments of the present disclosure, a width of a part of the flat tube groove located between adjacent leeward zones in the longitudinal direction increases gradually along a direction from the windward zone to the leeward zone.

The heat exchanger according to embodiments of a second aspect of the present disclosure includes: a first header pipe and a second header pipe; a plurality of fins, the fin is a fin according to embodiments of the first aspect of the present disclosure, the fins are spaced apart and disposed between the first header pipe and the second header pipe; and a flat tube, two ends of the flat tube are connected with the first header pipe and the second header pipe correspondingly and the flat tube is fitted in the flat tube groove correspondingly.

The heat exchanger according to embodiments of the present disclosure exhibits a rapid discharging speed of condensing water, a slow frosting speed, and high heat exchange efficiency via the above-mentioned fin.

Additional aspects and advantages of embodiments of present disclosure will be given in part in the following descriptions, become apparent in part from the following descriptions, or be learned from the practice of the embodiments of the present disclosure.

Figure 1:
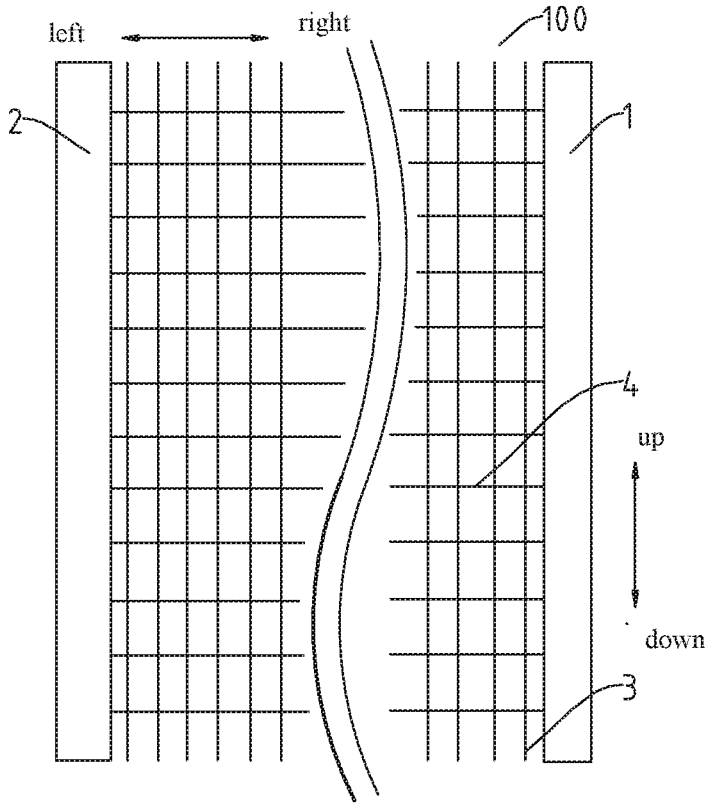
FIG. 1 is a structure schematic view of a heat exchanger according to embodiments of the present disclosure.

Reference numerals: heat exchanger 100, first header pipe 1, second header pipe 2, fin 3, flat tube 4, sheet body 5, cooling sheet unit 31, windward zone 311, main heat exchange zone 312, leeward zone 313, flat tube groove 314, protrusions 315, corrugated part 316 in the windward zone, planar zone 317, shutter 318, first shutter 318*a*, first air-guiding sheet 318*c*, second shutter 318*b*, second air-guiding sheet 318*d*, flanging 319.

DETAILED DESCRIPTION OF THE INVENTION

Embodiments of the present disclosure are described in detail in the following. The examples of the embodiments are illustrated in the drawings. The same or similar elements and the elements having same or similar functions are denoted by like reference numerals throughout the descriptions. The embodiments described herein with reference to drawings are explanatory, illustrative, and used to generally understand the present disclosure and cannot be construed to limit the present disclosure.

A fin 3 according to embodiments of the first aspect of the present disclosure will be described with reference to FIG. 1 to FIG. 9 in the following. The fin 3 is adapted to a micro-channel heat exchanger, which has advantages such as a high discharging speed of condensing water and a slow frosting speed, so that the heat exchange performance of the heat exchanger can be improved.

As illustrated in FIG. 1 to FIG. 9, the fin 3 according to embodiments of the present disclosure includes a sheet body 5.

Specifically, the sheet body 5 includes a plurality of cooling sheet units 31 arranged along a longitudinal direction (i.e. up and down directions in the figure) of the sheet body 5, each cooling sheet unit 31 includes a windward zone 311, a leeward zone 313 and a main heat exchange zone 312 arranged along a transverse direction (i.e. front and rear directions in the figure) of the sheet body 5, the main heat exchange zone 312 is located between the windward zone 311 and the leeward zone 313. For example, as illustrated in FIG. 2 and FIG. 5 to FIG. 9, the plurality of cooling sheet units 31 is arranged along the up and down directions, the windward zone 311, the leeward zone 313 and the main heat exchange zone 312 of each cooling sheet unit 31 are arranged along the front and rear directions, in which the windward zone 311 is located at a front end of the cooling sheet unit 31, the leeward zone 313 is located at a rear end of the cooling sheet unit 31, and the main heat exchange zone 312 is located between the windward zone 311 and the leeward zone 313. As in the accompanying drawings, the windward zones 311 of adjacent cooling sheet units 31 are connected to each other, so that the plurality of cooling sheet units 31 are connected to each other to form the sheet body 5, thus making a structure of the sheet body 5 reliable.

A flat tube groove 314 is formed between the adjacent cooling sheet units 31, the flat tube groove 314 is adapted to accommodate the flat tube of the heat exchanger, so that the fin 3 can be fixed to the heat exchanger by fitting the flat tube with the flat tube groove 314. The flat tube groove 314 extends between the leeward zone 313 and the main heat exchange zone 312 of one of the adjacent cooling sheet units 31 and the leeward zone 313 and the main heat exchange zone 312 of the other of the adjacent cooling sheet units 31, so that the heat exchange effect of the fin 3 and the flat tube is better. For example, as illustrated in FIG. 2 and FIG. 4 to FIG. 9, the flat tube groove 314 extends along the front and rear directions, the flat tube groove 314 runs through between the leeward zone 313 of the upper cooling sheet unit 31 and the leeward zone 313 of the lower cooling sheet unit 31, and the flat tube groove 314 runs through between the main heat exchange zone 312 of the upper cooling sheet unit 31 and the main heat exchange zone 312 of the lower cooling sheet unit 31.

Figure 3:
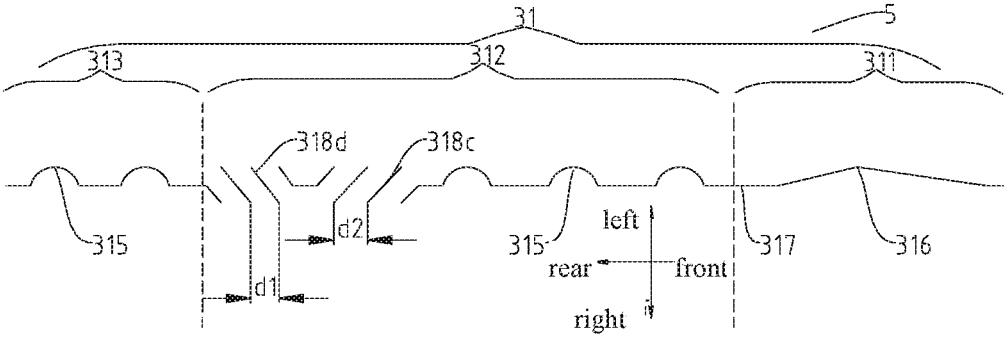
FIG. 3 is a transverse sectional view of a sheet body of a fin according to embodiments of the present disclosure.

Each cooling sheet unit 31 is provided with a plurality of protrusions 315 spaced apart from each other, and each protrusion 315 protrudes from a surface of the cooling sheet unit 31 (as illustrated in FIG. 3, each protrusion 315 protrudes leftwards from a left side surface of the cooling sheet unit 31). In this way, on one hand, the plurality of protrusions 315 can perform flow disturbance for air flowing to this position, enabling the air to flow around, so as to enhance turbulence effect of the air flow. In addition, the flowing direction of the air has a small extent of change, so that the heat exchange intensity of the cooling sheet unit 31 is concentrated at the plurality of the protrusions 315, thus the heat exchange intensity of the windward zone 311 can be reduced and the heat exchange effect of the fin 3 can be enhanced by setting the number, an arranging mode, a position, and a spacing of the protrusions 315. Furthermore, as the protrusions 315 don't baffle the air repeatedly, repeated turning of the airflow is little, so as to be advantageous for reducing the noise of air flowing.

On the other hand, when the frost layer at the surface of the cooling sheet unit 31 melts, the condensing water can flow downwards along an outer surface of the protrusions 315 under double actions of the gravity and the protrusions 315, thus, the plurality of protrusions 315 accelerates the discharging of the condensing water, and can decrease the humidity of the air and slow down the frosting speed of the fin 3.

Meanwhile, the plurality of protrusions 315 can also block the penetration of dust or foreign objects and prevent the fin 3 from being blocked. In addition, the plurality of protrusions 315 are spaced apart from each other, and there is a flat area between adjacent two protrusions 315, thus reducing the windage resistance of the air flowing through the position.

It can be understood that by setting the number, position, arranging mode, and spacing of the protrusions 315, it is possible to both control the flow condition of the air to control the heat exchange intensity of the windward zone 311, and control the windage resistance in an appropriate range, and it is also possible to improve the discharging condition of the condensing water on the fin 3.

In summary, with the fin 3 according to embodiments of the present disclosure, via the windward zone 311, the main heat exchange zone 312, and the leeward zone 313 connected with each other as well as the plurality of the protrusions 315, it is possible to effectively alleviate the heat exchange intensity of the windward zone 311 of the fin 3, fully dehumidify the air and slow down the frosting speed of the windward zone 311 of the fin 3, thereby improving the heat exchange efficiency of the heat exchanger and the stability of the temperature of the heat exchange system. In addition, the plurality of protrusions 315 also accelerates the discharging of the condensing water, thus improving the overall performance of the heat exchange system.

According to some embodiments of the present disclosure, as illustrated in FIG. 2 to FIG. 3 and FIG. 5 to FIG. 9, the protrusions 315 can be provided with a flow-guiding curved surface or a flow-guiding inclined surface, so that the condensing water can flow along the flow-guiding curved surface or the flow-guiding inclined surface, which is beneficial for the condensing water to flow out of the fin 3 faster.

Figure 7:
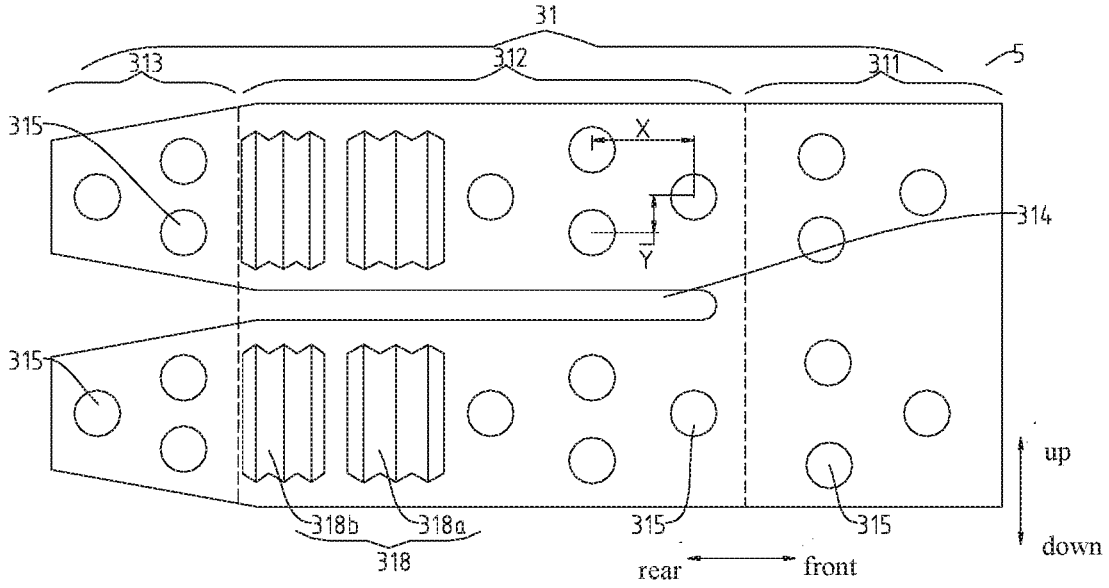
FIG. 7 is a structure schematic view of a sheet body of a fin according to a third alternative embodiment of the present disclosure.
Figure 8:
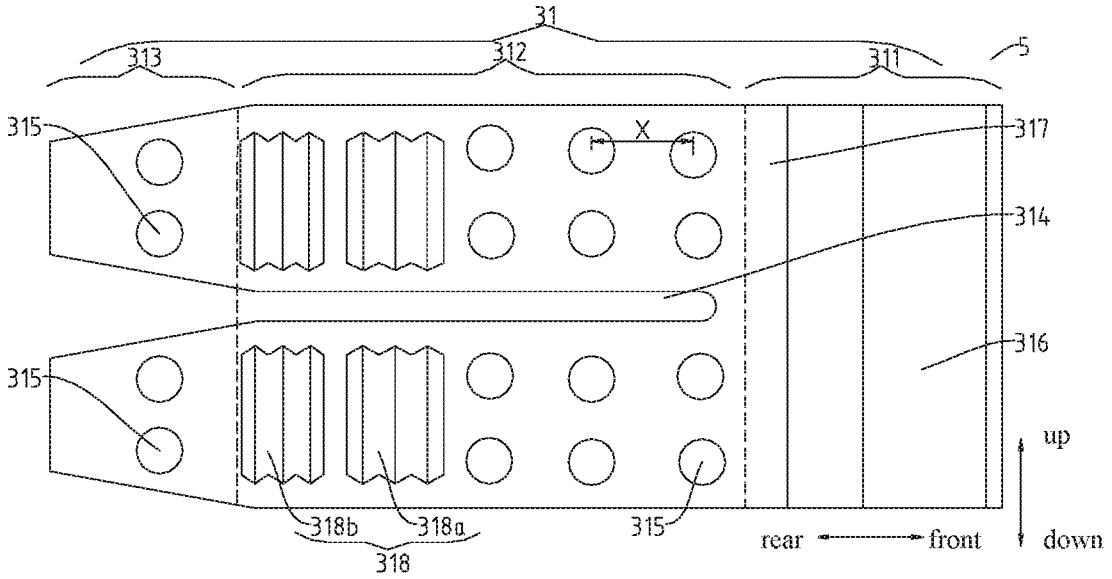
FIG. 8 is a structure schematic view of a sheet body of a fin according to a fourth alternative embodiment of the present disclosure.
Figure 9:
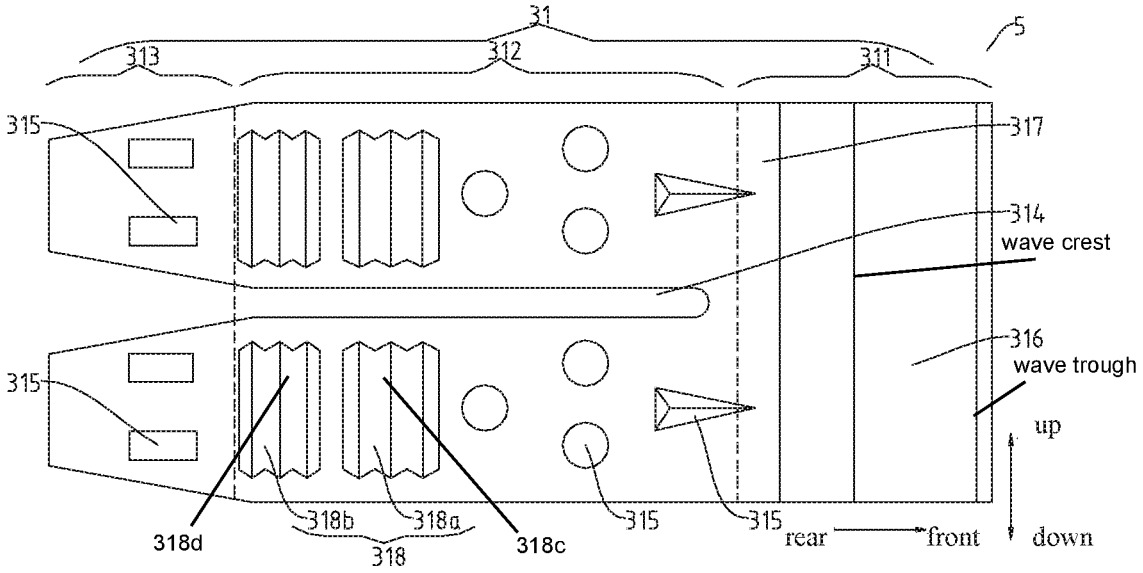
FIG. 9 is a structure schematic view of a sheet body of a fin according to a fifth alternative embodiment of the present disclosure.

According to some embodiments of the present disclosure, the protrusions 315 can be formed to be in a hemispherical shape, a cylindrical shape or a conic shape, so that the protrusions 315 has the flow-guiding curved surface, or the protrusions 315 can be a column or a cone having a polygonal cross section, in this case the protrusions 315 has the flow-guiding inclined surface. It can be understood that the plurality of protrusions 315 may have the same shape or different shapes (i.e., may be a combination of the above shapes). For example, as illustrated in FIG. 2 to FIG. 3 and FIG. 5 to FIG. 8, the protrusions 315 are all in hemispherical shape. Another example, as illustrated in FIG. 9, a part of the protrusions 315 are columns having the polygonal cross-sections, another part of the protrusions 315 are in the hemispherical shape, and the remaining protrusions 315 are the cones having the triangular cross sections.

Figure 2:
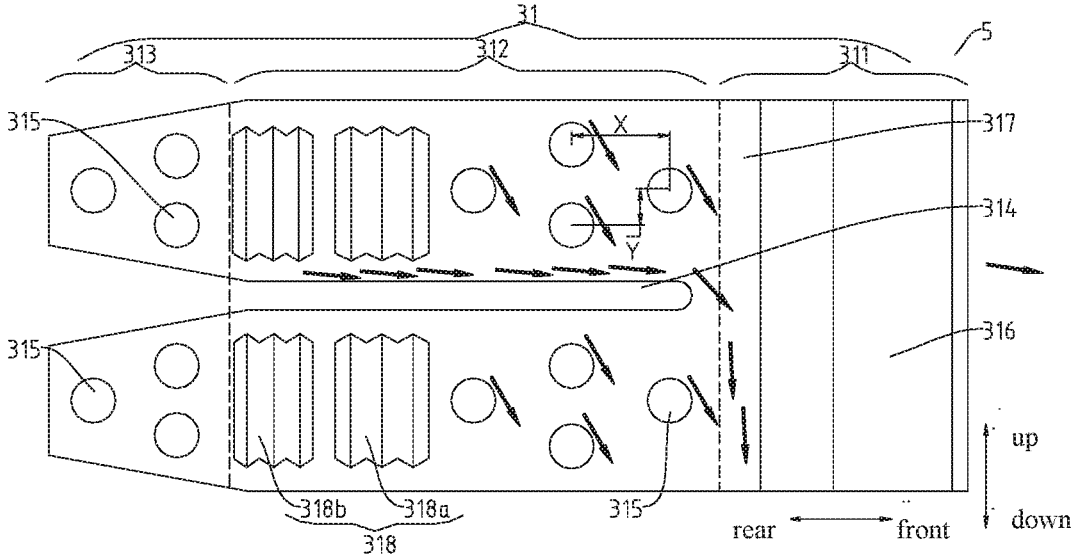
FIG. 2 is a structure schematic view of a sheet body of a fin according to embodiments of the present disclosure.
Figure 5:
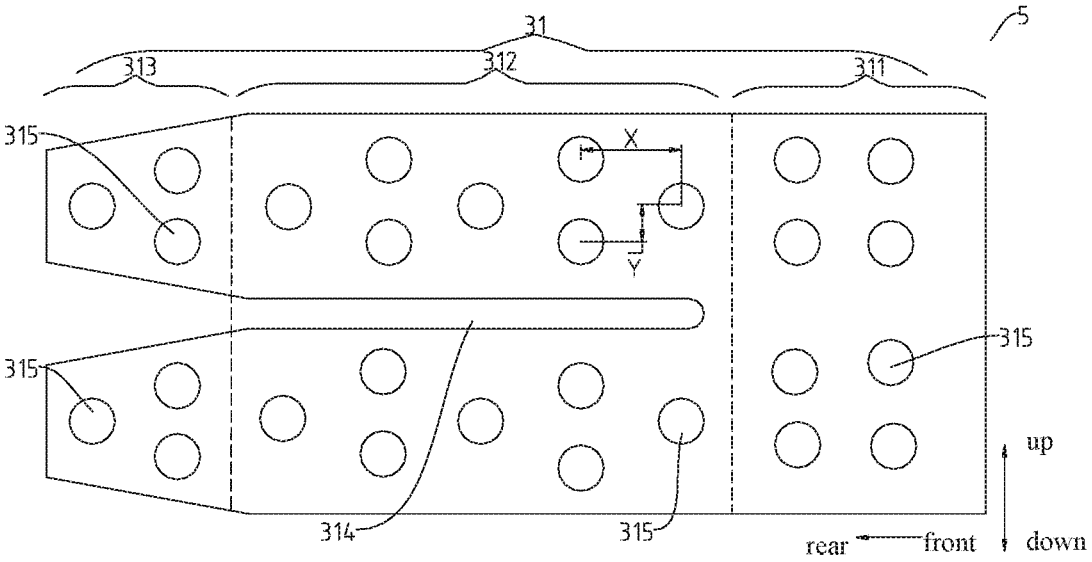
FIG. 5 is a structure schematic view of a sheet body of a fin according to a first alternative embodiment of the present disclosure.
Figure 6:
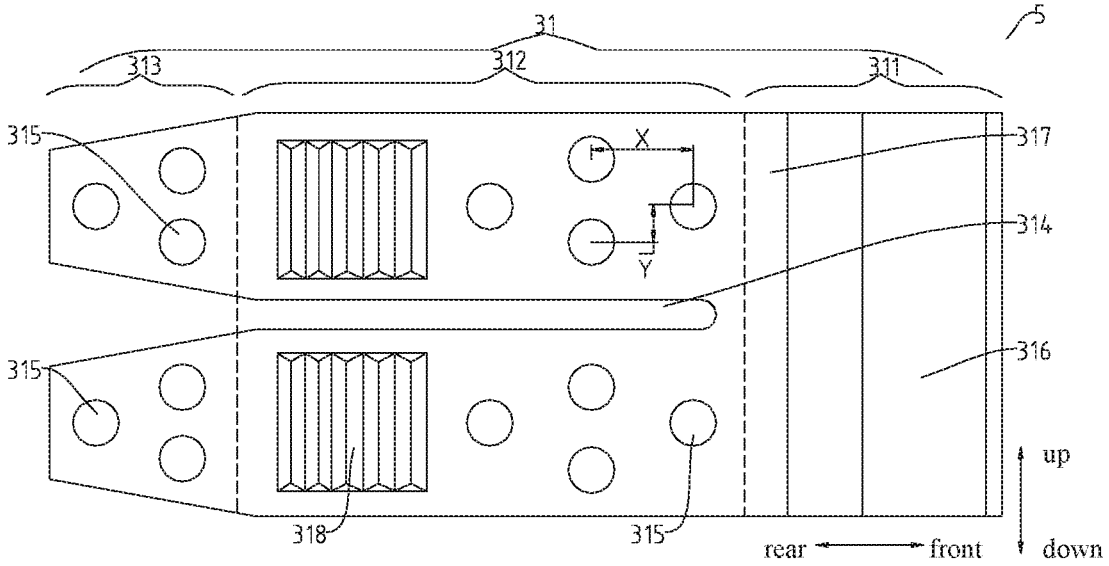
FIG. 6 is a structure schematic view of a sheet body of a fin according to a second alternative embodiment of the present disclosure.

According to some embodiments of the present disclosure, the plurality of protrusions 315 can be separated into a plurality of groups, each group of the protrusions 315 is arranged to be in a straight line, a triangle or a polygon. For example, as illustrated in FIG. 2 and FIG. 6 to FIG. 7, one group of the protrusions 315 in the leeward zone 313 is arranged to be in the triangle, and one group of the protrusions 315 in the main heat exchange zone 312 is arranged to be in a rhombus. For another example, as illustrated in FIG. 8, each group of the protrusions 315 is arranged in the straight line. Still for another example, as illustrated in FIG. 9, one group of the protrusions 315 located in the leeward zone 313 is arranged to be in the straight line, and one group of the protrusions 315 located in the main heat exchange zone 312 is arranged to be in the triangle. Certainly, as illustrated in FIG. 5, the arrangements of the plurality groups of protrusions 315 can also be a combination of the straight line, the triangle and the polygon.

In the embodiments illustrated in FIG. 2 to FIG. 8, a projection of the protrusion 315 on the sheet body 5 is a circle, and in the main heat exchange zone 312, a smallest spacing of an edge of the flat tube groove 314 from an outer periphery of the protrusions 315 is not smaller than (in the descriptions of the present disclosure, the term "not smaller than" includes conditions of "larger than" or "equal to") a radius of the protrusions 315. That is, the protrusions 315 in the main heat exchange zone 312 is spaced apart from the flat tube, so that the airflow in the main heat exchange zone 312 can be disturbed effectively, so as to enhance the heat exchange effect. In addition, the condensing water in the main heat exchange zone 312 is gathered near the flat tube under the action of gravity, as the protrusions 315 is not arranged adjacent to the flat tube, so that the discharging of the condensing water is not influenced, which prevents the frosting layer near the flat tube from increasing greatly after the heat exchanger runs for a long time, hence guaranteeing the operation performance of the heat exchanger. Optionally, a distance between two most remote protrusions 315 in the main heat exchange zone 312 in the upper and down directions occupies 20%-80% of a height of the main heat exchange zone 312 in the upper and down directions, so that the protrusions 315 in the main heat exchange zone 312 are mutually dispersedly arranged, thus preventing the discharging of the condensing water attached to the surface of the protrusions 315 from being influenced due to a too close distance between the protrusions 315.

Further, as illustrated in FIG. 2 and FIG. 5 to FIG. 8, a spacing X, in the front and rear directions, of centers of two adjacent protrusions 315 in the front and rear directions is larger than or equal to the diameter of the protrusions 315, or a spacing Y, in the upper and down directions, of centers of two adjacent protrusions 315 in the upper and down directions is larger than or equal to the diameter of the protrusions 315, in this way, the protrusions 315 in the main heat exchange zone 312 is arranged to be more dispersedly. Particularly, as illustrated in FIG. 2 and FIG. 5 to FIG. 7, when the protrusions 315 is arranged to be in a triangle or a polygon, the distance between the protrusions 315 satisfies: X is larger than or equal to the diameter of the protrusion 315, and Y is larger than or equal to the diameter of the protrusion 315.

As a preferable embodiment, the diameter of the protrusion 315 is 20%-30% of the height of the cooling sheet unit 31 in the longitudinal direction, so that the protrusions 315 can disturb the airflow effectively and don't influence the discharging of the condensing water.

As illustrated in FIG. 2 to FIG. 3 and FIG. 5 to FIG. 9, according to some embodiments of the present disclosure, an area of the projection of each protrusion 315 in the leeward zone 313 on the sheet body 5 is not larger than an area of the projection of each protrusion 315 in the main heat exchange zone 312 on the sheet body 5. In this way, the heat exchange intensity of the fin 3 is concentrated in the main heat exchange zone 312, the discharging of the condensing water in the main heat exchange zone 312 is accelerated, and the frosting speed in the main heat exchange zone 312 is slowed down.

Figure 4:
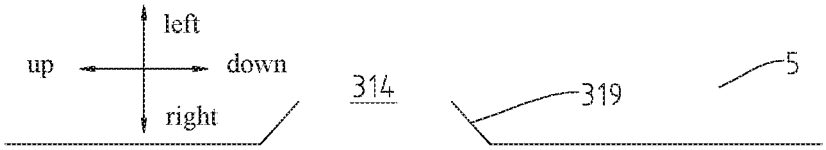
FIG. 4 is a longitudinal sectional view of a sheet body of a fin according to embodiments of the present disclosure.

As illustrated in FIG. 2 and FIG. 4, according to some embodiments of the present disclosure, the edge of the flat tube groove 314 is provided with a flanging 319. The flanging 319 is adapted to be fitted closely with the flat tube so as to facilitate a brazed connection of the flat tube with the fin 3. In addition, as the flanging 319 increase a contact area between the fin 3 and the flat tube, so that the connecting strength between the fin 3 and the flat tube is enhanced. Further, as illustrated in FIG. 4, a bending direction of the flanging 319 is consistent with a protruding direction of the protrusions 315, for example, the flanging 319 bends leftwards and the protrusions 315 protrudes leftwards.

As illustrated in FIG. 2 and FIG. 5 to FIG. 9, according to some embodiments of the present disclosure, a width of a part of the flat tube groove 314 located between adjacent leeward zones 313 in the longitudinal direction increases gradually along a direction from the windward zone 311 to the leeward zone 313. That is, the width of the flat tube groove 314 in the upper and down directions increases gradually from the front to the rear so as to be convenient for the flat tube to be inserted into the flat tube groove 314 smoothly.

The fin 3 according to a specific embodiment of the present disclosure is described in detail in the following with reference to FIG. 2 to FIG. 4. It should be understood that the following description is just illustrative and should not be construed as a limitation of the present disclosure. It should be noted that FIG. 2 only illustrates the schematic view of two adjacent cooling sheet units 31 of the fin 3.

As illustrated in FIG. 2, the sheet body 5 has a corrugated part 316 located in the windward zone 311, and a wave crest and a wave trough of the corrugated part 316 extend along the longitudinal direction (i.e. the up and down directions illustrated in the figures) of the sheet body 5 separately, thus the condensing water coming from the main heat exchange zone 312 can flow along the corrugated part 316 under the action of the gravity, which accelerates the discharging speed of the condensing water and reduces the accumulation degree of the condensing water in the windward zone 311. Furthermore, the corrugated part 316 can perform first dehumidification for the air flowing through so as to decrease the humidity of the air entering the main heat exchange zone 312. In addition, the corrugated part 316 can further increase the structural strength of the cooling sheet unit 31, thus reducing a deformation amount of the windward zone 311. Preferably, as illustrated in FIG. 3, a cross section of the corrugated part 316 is substantially formed to be V-shaped, and a width of the corrugated part 316 in the front and rear directions occupies 70% of a width of the windward zone 311 in the front and rear directions, thus the discharging effect of the condensing water is good.

Further, as illustrated in FIG. 2 and FIG. 3, the corrugated part 316 in the windward zone 311 is spaced apart from the main heat exchange zone 312 by a planar zone 317, so that the condensing water coming from the main heat exchange zone 312 can be gathered to the planar zone 317 under the guidance of the protrusions 315, and flow downwards along the planar zone 317 under the action of the gravity, so as to be discharged out of the fin 3, thus further accelerating the discharging speed of the condensing water and reducing the accumulation degree of the condensing water in the windward zone 311. Preferably, an area of the planar zone 317 occupies 20% of an area of the windward zone 311, thereby ensuring a higher discharging speed of the condensing water.

The plurality of protrusions 315 in the hemispherical shape is only provided in a front segment of the main heat exchange zone 312 and the leeward zone 313 of the cooling sheet unit 31, so that the heat exchange intensity of the windward zone 311 is reduced, and the condensing water can flow along an arc surface of the protrusions 315, which is favorable for the condensing water to flow out of the fin 3 faster. The plurality of protrusions 315 is separated into two groups, one group of the protrusions 315 located in the main heat exchange zone 312 is arranged in a rhombus, and one group of the protrusions 315 located in the leeward zone 313 is arranged in a triangle, thus reducing the windage resistance at the front segment of the main heat exchange zone 312, increasing the heat exchange intensity of the leeward zone 313, and strengthening the structure of the leeward zone 313.

The main heat exchange zone 312 is further provided with a shutter 318, and the shutter 318 is adjacent to the leeward zone 313 and located between the protrusions 315 in the main heat exchange zone 312 and the protrusions 315 in the leeward zone 313. That is, the shutter 318 is located at a rear segment of the main heat exchange zone 312, and the plurality of protrusions 315 in the main heat exchange zone 312 is arranged in the front segment of the main heat exchange zone 312. Optionally, a width of the shutter 318 in the front and rear directions occupies 40% of a width of the main heat exchange zone 312 in the front and rear directions. Correspondingly, a width of the plurality of protrusions 315 in the main heat exchange zone 312 in the front and rear directions occupies 60% of the width of the main heat exchange zone 312 in the front and rear directions. In this way, the plurality of protrusions 315 in the main heat exchange zone 312 and the shutter 318 are arranged from the front to the rear along the flowing direction of the air, so that the air entering the main heat exchange zone 312 can firstly pass through the plurality of protrusions 315 to experience a second dehumidification and then through the shutter 318 to experience the heat exchange, thus enhancing the heat exchange effect of the fin 3.

Further, as illustrated in FIG. 2, the shutter 318 includes a first shutter **318*a* and a second shutter 318*b* spaced apart along the transverse direction of the sheet body 5, the second shutter 318*b* is more adjacent to the leeward zone 313 relative to the first shutter 318*a*, that is, the first shutter 318*a* and the second shutter 318*b* are spaced apart in the front and rear directions, and the first shutter 318*a* is located in front of the second shutter 318*b*, thus further enhancing the heat exchange effect of the fin 3. As illustrated in FIG. 3, the first shutter 318*a* is provided with a plurality of first air-guiding sheets 318*c* extending obliquely and rightwards from the main heat exchange zone 312 to the leeward zone 313, and the second shutter 318*b* is provided with a plurality of second air-guiding sheets 318*d* extending obliquely and rightwards from the main heat exchange zone 312 to the windward zone 311. That is, the first air-guiding sheet 318*c* extends obliquely and rightwards from the front to the rear, and the second air-guiding sheet 318*d* extends obliquely and rightwards from the rear to the front, the first air-guiding sheet 318***c* and the second air-guiding sheet 318*d* form a substantially splayed structure, which is beneficial for the air to flow in through the first air-guiding sheet 318*c* and flow out through the second air-guiding sheet 318*d*, further enhancing the heat exchange effect of the shutter 318.

Preferably, a spacing d2 of adjacent first air-guiding sheets 318*c* is larger than a spacing d1 of adjacent second air-guiding sheets 318*d*, i.e. d2>d1, which can prevent most of frosting layer from concentrating in the first shutter 318*a* and guarantee the heat exchange effect of the second shutter 318*b*. It could be understood that an opening direction of the first shutter 318*a* is same as a protruding direction of the protrusions 315 of the main heat exchange zone 312, thus the air flowing through the protrusions 315 of the main heat exchange zone 312 can smoothly enter the first shutter 318*a* to perform heat exchange.

The fin 3 illustrated in FIG. 2 to FIG. 4 is suitable for the micro-channel heat exchanger, by disposing the corrugated part 316 in the windward zone 311, the shutter 318 in the main heat exchange zone 312, and the protrusions 315 in the main heat exchange zone 312 and the leeward zone 313, it is possible to guarantee the strength of the fin 3 in the transverse direction and the longitudinal direction and reduce the deformation degree of the fin 3 during the assembly and transportation. In addition, by controlling the heat exchange intensity at different zones of the fin 3, the frosting amount on the fin 3 can be distributed reasonably and the frosting speed of the heat exchanger can be slowed down.

The fin 3 according to a first alternative embodiment of the present disclosure will be described in detail below with reference to FIG. 5. It should be understood that the following description is only exemplary and should not be construed as a limitation of the present disclosure. It should be noted that, FIG. 5 only illustrates the structure schematic view of the two adjacent cooling sheet units 31 of the fin 3.

As illustrated in FIG. 5, the plurality of protrusions 315 in hemispherical shape are provided in the windward zone 311, the main heat exchange zone 312 and the leeward zone 313 of the cooling sheet unit 31 separately. The plurality of protrusions 315 are separated into five groups, two groups of the protrusions 315 located in the windward zone 311 are arranged in a straight line separately, two groups of protrusions 315 located in the main heat exchange zone 312 are arranged in a rhombus and share a common protrusion 315, and one group of the protrusions 315 in the leeward zone 313 is arranged in a triangle, thus the windage resistance of the main heat exchange zone 312 is small, the heat exchange intensity of the leeward zone 313 is increased, and structures of the windward zone 311 and the leeward zone 313 are enhanced.

The fin 3 illustrated in FIG. 5 is suitable for the micro-channel heat exchanger, which can effectively alleviate the heat exchange intensity of the windward zone 311 of the fin 3, has a great dehumidification effect on the air, can slow down the frosting speed of the windward zone 311 of the fin 3, such that the heat exchange efficiency of the heat exchanger is high and the temperature of the heat exchange system is more stable. In addition, the plurality of protrusions 315 enables a higher discharging speed of the condensing water and better overall performance of the heat exchange system.

The fin 3 according to a second alternative embodiment of the present disclosure will be described in detail below with reference to FIG. 6. It should be understood that the following description is only exemplary and should not be construed to limit the present disclosure. It should be noted that, FIG. 6 only illustrates the structure schematic view of the two adjacent cooling sheet units 31 of the fin 3.

As illustrated in FIG. 6, the sheet body 5 has the corrugated part 316 located in the windward zone 311, and the wave crest and the wave trough of the corrugated part 316 extend along the up and down directions of the sheet body 5 separately, and the corrugated part 316 is spaced apart from the main heat exchange zone 312 by the planar zone 317. Preferably, the width of the corrugated part 316 in the front and rear directions occupies 70% of the width of the windward zone 311 in the front and rear directions, so that the discharging effect of the condensing water is good. The area of the planar zone 317 occupies 20% of an area of the windward zone 311, thereby ensuring a higher discharging speed of the condensing water.

The plurality of protrusions 315 in the hemispherical shape is only provided in the main heat exchange zone 312 and the leeward zone 313 of the cooling sheet unit 31. The plurality of protrusions 315 is separated into two groups, one group of the protrusions 315 located in the main heat exchange zone 312 is arranged in a rhombus, and one group of the protrusions 315 located in the leeward zone 313 is arranged in a triangle, thus the heat exchange intensity of the windward zone 311 is small, the windage resistance of the main heat exchange zone 312 is small, the heat exchange intensity of the leeward zone 313 is increased, and the structure of the leeward zone 313 is strengthened.

The main heat exchange zone 312 is further provided with the shutter 318, the shutter 318 is located at the rear segment of the main heat exchange zone 312, and the plurality of protrusions 315 in the main heat exchange zone 312 is arranged in the front segment of the main heat exchange zone 312. The width of the shutter 318 in the front and rear directions occupies 40% of the width of the main heat exchange zone 312 in the front and rear directions, and correspondingly, the width of the plurality of protrusions 315 in the main heat exchange zone 312 in the front and rear directions occupies 60% of the width of the main heat exchange zone 312 in the front and rear directions.

The fin 3 illustrated in FIG. 6 is suitable for the micro-channel heat exchanger, which can effectively alleviate the heat exchange intensity of the windward zone 311 of the fin 3, increase the discharging speed of the condensing water, and slow down the frosting speed of the windward zone 311 of the fin 3, such that the heat exchange efficiency of the heat exchanger is high.

The fin 3 according to a third alternative embodiment of the present disclosure will be described in detail below with reference to FIG. 7. It should be understood that the following description is only exemplary and should not be construed to limit the present disclosure. It should be noted that, FIG. 7 only illustrates the structure schematic view of the two adjacent cooling sheet units 31 of the fin 3.

As illustrated in FIG. 7, the plurality of protrusions 315 in hemispherical shape are provided in the windward zone 311, the main heat exchange zone 312 and the leeward zone 313 of the cooling sheet unit 31 separately. The plurality of protrusions 315 are separated into three groups, one group of protrusions 315 located in the windward zone 311 is arranged in a triangle, one group of protrusions 315 located in the main heat exchange zone 312 is arranged in a rhombus, and one group of the protrusions 315 in the leeward zone 313 is arranged in a triangle, thus the windage resistance of the main heat exchange zone 312 is small, and structural strengths of the windward zone 311 and the leeward zone 313 are high.

The main heat exchange zone 312 is further provided with the shutter 318, the shutter 318 is adjacent to the leeward zone 313 and located between the protrusions 315 in the main heat exchange zone 312 and the protrusions 315 in the leeward zone 313, the shutter 318 includes the first shutter 318*a* and the second shutter 318*b* spaced apart along the front and rear directions, and the first shutter 318*a* is located in front of the second shutter 318*b*. Specific structures of the first shutter 318*a* and the second shutter 318*b* are same as what mentioned above, which will not be elaborated herein.

The fin 3 illustrated in FIG. 7 is suitable for the micro-channel heat exchanger, which has higher discharging speed of the condensing water, a great dehumidification effect on the air, and can slow down the frosting speed of the windward zone 311 of the fin 3, improve the heat exchange efficiency of the heat exchanger, and guarantee the temperature stability of the heat exchange system.

The fin 3 according to a fourth alternative embodiment of the present disclosure will be described in detail below with reference to FIG. 8. It should be understood that the following description is only exemplary and should not be construed to limit the present disclosure. It should be noted that, FIG. 8 only illustrates the structure schematic view of the two adjacent cooling sheet units 31 of the fin 3.

As illustrated in FIG. 8, the sheet body 5 has the corrugated part 316 located in the windward zone 311, and the wave crest and the wave trough of the corrugated part 316 extend along the up and down directions of the sheet body 5 separately, and the corrugated part 316 is spaced apart from the main heat exchange zone 312 by the planar zone 317. The width of the corrugated part 316 in the front and rear directions occupies 70% of the width of the windward zone 311 in the front and rear directions, and the area of the planar zone 317 occupies 20% of the area of the windward zone 311.

The plurality of protrusions 315 in the hemispherical shape is only provided in the main heat exchange zone 312 and the leeward zone 313 of the cooling sheet unit 31. The plurality of protrusions 315 is separated into four groups, three groups are disposed in the main heat exchange zone 312 and one group of the protrusions 315 is disposed in the leeward zone 313. Each group of the protrusions 315 is arranged in a straight line along the up and down directions so that the windage resistance at the main heat exchange zone 312 and the leeward zone 313 is reduced.

The main heat exchange zone 312 is further provided with the shutter 318, and the shutter 318 is adjacent to the leeward zone 313 and located between the protrusions 315 in the main heat exchange zone 312 and the protrusions 315 in the leeward zone 313. The shutter 318 includes the first shutter 318*a* and the second shutter 318*b* spaced apart along the front and rear directions, and the first shutter 318*a* is located in front of the second shutter 318*b*. Specific structures of the first shutter 318*a* and the second shutter 318*b* are same as what mentioned above, which will not be elaborated herein.

The fin 3 illustrated in FIG. 8 is suitable for the micro-channel heat exchanger, which can effectively increase the heat exchange efficiency of the heat exchanger and improve the overall performance of the heat exchanger.

The fin 3 according to a fifth alternative embodiment of the present disclosure will be described in detail below with reference to FIG. 9. It should be understood that the following description is only exemplary and should not be construed to limit the present disclosure. It should be noted that, FIG. 9 only illustrates the structure schematic view of the two adjacent cooling sheet units 31 of the fin 3.

As illustrated in FIG. 9, the sheet body 5 has the corrugated part 316 located in the windward zone 311, and the wave crest and the wave trough of the corrugated part 316 extend along the up and down directions of the sheet body 5 separately, and the corrugated part 316 is spaced apart from the main heat exchange zone 312 by the planar zone 317. The width of the corrugated part 316 in the front and rear directions occupies 70% of the width of the windward zone 311 in the front and rear directions, and the area of the planar zone 317 occupies 20% of the area of the windward zone 311.

The plurality of protrusions 315 is only provided in the main heat exchange zone 312 and the leeward zone 313 of the cooling sheet unit 31. The plurality of protrusions 315 is separated into two groups, one group of the protrusions 315 in the leeward zone 313 is arranged in a straight line and the protrusions 315 are columns having a rectangular cross section. One group of the protrusions 315 in the main heat exchange zone 312 is arranged in a rhombus and a part of the protrusions 315 are in a hemispherical shape and another part of the protrusions 315 are cones having triangular cross section.

The main heat exchange zone 312 is further provided with the shutter 318, the shutter 318 is adjacent to the leeward zone 313 and located between the protrusions 315 in the main heat exchange zone 312 and the protrusions 315 in the leeward zone 313, the shutter 318 includes the first shutter 318*a* and the second shutter 318*b* spaced apart along the front and rear directions, and the first shutter 318*a* is located in front of the second shutter 318*b*. Specific structures of the first shutter 318*a* and the second shutter 318*b* are same as what mentioned above, which will not be elaborated herein.

The fin 3 illustrated in FIG. 9 is suitable for the micro-channel heat exchanger, which can increase the discharging speed of the condensing water, slow down the frosting speed of the fin 3, thereby effectively increasing the heat exchange efficiency of the heat exchanger and improving the overall performance of the heat exchanger.

As illustrated in FIG. 1, the heat exchanger 100 according to embodiments of the second aspect of the present disclosure includes a first header pipe 1, a second header pipe 2, a plurality of fins and the flat tube 4.

The fin is the fin 3 according to the above-mentioned embodiments of the present disclosure, and the fins 3 are disposed between the first header pipe 1 and the second header pipe 2 and spaced apart. Two ends of the flat tube 4 are connected with the first header pipe 1 and the second header pipe 2 correspondingly and the flat tube 4 is fitted in the flat tube groove 314 correspondingly. For example, as illustrated in FIG. 1, the fin 3 extends along the up and down directions, the flat tube 4 extends along the left and right directions, the fin 3 and the flat tube 4 are disposed perpendicularly to each other, thus each fin 3 is connected with a plurality of flat tubes 4, each flat tube 4 is connected with the plurality of fins 3, and the fin 3 and the flat tube 4 are connected with each other reliably.

With the fin 3, the heat exchanger 100 according to embodiments of the present disclosure exhibits a high discharging speed of condensing water, a slow frosting speed, and high heat exchange efficiency.

In the specification, it is to be understood that terms such as "longitudinal," "lateral," "width," "thickness," "upper," "lower," "front," "rear," "left," "right," "inner," "outer," should be construed to refer to the orientation as then described or as shown in the drawings under discussion. These relative terms are for convenience of description and do not require that the present disclosure be constructed or operated in a particular orientation, thus cannot be construed to limit the present disclosure. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, it should be understood that the terms "mounted," "connected," "coupled" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

Reference throughout this specification to "an embodiment," "some embodiments," "an alternative embodiment", and "a specific embodiment" means that a particular feature, structure, material, or characteristic described in connection with the embodiment or example is included in at least one embodiment of the present disclosure. Thus, the appearances of the phrases in various places throughout this specification are not necessarily referring to the same embodiment of the present disclosure. Furthermore, the particular features, structures, materials, or characteristics may be combined in any suitable manner in one or more embodiments.

Although embodiments of the present disclosure have been shown and described, it would be appreciated by those skilled in the art that changes, alternatives, variation and modifications can be made in the embodiments without departing from spirit and principles of the present disclosure. The scope of the present disclosure is defined by the claim and its equivalents.

What is claimed is:

1. A heat exchanger, comprising:

a first header pipe and a second header pipe;

a plurality of fins, wherein the fins are spaced apart and disposed between the first header pipe and the second header pipe; and a flat tube, two ends of the flat tube are connected with the first header pipe and the second header pipe correspondingly and the flat tube is fitted in a flat tube groove correspondingly, each fin comprising a sheet body, the sheet body comprising a plurality of cooling sheet units arranged along a longitudinal direction of the sheet body, each cooling sheet unit comprising a windward zone, a leeward zone and a main heat exchange zone arranged along a transverse direction of the sheet body, the main heat exchange zone being located between the windward zone and the leeward zone, the windward zones of adjacent cooling sheet units being connected to each other, the flat tube groove being formed between the adjacent cooling sheet units, the flat tube groove extending between the leeward zone and the main heat exchange zone of one of the adjacent cooling sheet units and the leeward zone and the main heat exchange zone of the other of the adjacent cooling sheet units, each cooling sheet unit being provided with a plurality of protrusions protruding from a surface of the cooling sheet unit and spaced apart from each other, wherein all the plurality of protrusions are arranged in the leeward zone and the main heat exchange zone, the main heat exchange zone is further provided with a shutter, and the shutter is adjacent to the leeward zone and located between all protrusions in the main heat exchange zone and all protrusions in the leeward zone, wherein the protrusions are only provided in the main heat exchange zone and the leeward zone.

2. The heat exchanger as set forth in claim 1, wherein at least one of the plurality of protrusions is provided with a flow-guiding curved surface or a flow-guiding inclined surface.

3. The heat exchanger as set forth in claim 1, wherein at least one of the plurality of protrusions is formed to be in a hemispherical shape, a cylindrical shape or a conic shape, or to be a column or a cone having a polygonal cross section.

4. The heat exchanger as set forth in claim 1, wherein the plurality of protrusions is separated into a plurality of groups, each group of the protrusions is arranged to be in a straight line, a triangle or a polygon.

5. The heat exchanger as set forth in claim 1, wherein the sheet body has a corrugated part located in the windward zone, and a wave crest and a wave trough of the corrugated part extend along the longitudinal direction of the sheet body separately.

6. The heat exchanger as set forth in claim 5, wherein the corrugated part in the windward zone is separated from the main heat exchange zone by a planar zone.

7. The heat exchanger as set forth in claim 6, wherein the windward zone comprises the corrugated part and the planar zone, a ratio of an area of the planar zone to an area of the windward zone is 20%.

8. The heat exchanger as set forth in claim 1, wherein the shutter comprises a first shutter and a second shutter spaced apart along the transverse direction of the sheet body, the second shutter is more adjacent to the leeward zone relative to the first shutter, the first shutter is provided with a plurality of first air-guiding sheets extending obliquely from the main heat exchange zone to the leeward zone, and the second shutter is provided with a plurality of second air-guiding sheets extending obliquely from the main heat exchange zone to the windward zone.

9. The heat exchanger as set forth in claim 8, wherein a spacing of adjacent first air-guiding sheets is larger than a spacing of adjacent second air-guiding sheets.

10. The heat exchanger as set forth in claim 1, wherein at least one of the plurality of protrusions on a plane where the sheet body exists is a circle, and in the main heat exchange zone, a smallest spacing of an edge of the flat tube groove from an outer periphery of the circle is not smaller than a radius of the circle.

11. The heat exchanger as set forth in claim 10, wherein a diameter of the circle is 20%-30% of a height of the cooling sheet unit in the longitudinal direction.

12. The heat exchanger as set forth in claim 1, wherein an area of at least one of the plurality of protrusions in the leeward zone on the plane where the sheet body exists is not larger than an area of a projection of the protrusion in the main heat exchange zone on the plane where the sheet body exists.

13. The heat exchanger as set forth in claim 1, wherein the edge of the flat tube groove is provided with a flanging.

14. The heat exchanger as set forth in claim 13, wherein a bending direction of the flanging is consistent with a protruding direction of the protrusions.

15. The heat exchanger as set forth in claim 1, wherein a width of a part of the flat tube groove located between adjacent leeward zones in the longitudinal direction increases gradually along a direction from the windward zone to the leeward zone.

* * * * *